United States Patent [19]

Hunter

[11] 4,440,059

[45] Apr. 3, 1984

[54] SOUND RESPONSIVE LIGHTING DEVICE WITH VCO DRIVEN INDEXING

[75] Inventor: Gray H. Hunter, Atlanta, Ga.

[73] Assignee: Daniel Lee Egolf, San Francisco, Calif. ; a part interest

[21] Appl. No.: 332,223

[22] Filed: Dec. 18, 1981

[51] Int. Cl.[3] ..... A63J 17/00

[52] U.S. Cl. ..... 84/464 R; 340/815.11

[58] Field of Search ..... 84/464 R, 464 A; 340/815.11, 706, 782; 40/427, 442, 906; 362/103-108, 806, 811

[56] References Cited

U.S. PATENT DOCUMENTS

| | | | |
|---|---|---|---|
| 4,161,018 | 7/1979 | Briggs et al. | 362/104 |
| 4,164,823 | 8/1979 | Marsico | 40/427 |
| 4,215,277 | 7/1980 | Weiner et al. | 307/41 |
| 4,254,451 | 3/1981 | Cochran, Jr. | 362/103 |
| 4,262,338 | 4/1981 | Gaudio, Jr. | 84/464 R X |
| 4,265,159 | 5/1981 | Liebmann et al. | 84/464 R |
| 4,267,561 | 5/1981 | Karpinsky et al. | 358/82 |
| 4,346,640 | 8/1982 | Zeno et al. | 84/464 R |

*Primary Examiner*—William B. Perkey
*Attorney, Agent, or Firm*—Jones & Askew

[57] ABSTRACT

A sound responsive variable visual display (light organ) including an array 25 of light-emitting diodes arranged along a pair of orthogonal axes. A pair of counters (58, 60) having decoded outputs (30, 35) forming common connection points of the anodes and cathodes, each connection point corresponding to one point on one of the orthogonal axes, to activate one diode at a time. The counters are driven by independent voltage controlled oscillators (49, 50) with independent quiescent frequency adjustments (51, 52). The control voltage (38) is an electrical analog of an audio sound field in which the device is placed as detected by a microphone (12). Also shown are alternate arrangements for reversing the direction of indexing of the elements in the array along the axes, one to reverse counter direction in response to reaching predetermined high and low counts (71) and an alternate apparatus (48, 79) including a voltage controlled oscillator (48) for switching between an up and down counting direction.

4 Claims, 6 Drawing Figures

SOUND RESPONSIVE LIGHTING DEVICE WITH VCO DRIVEN INDEXING

TECHNICAL FIELD

The present invention relates to sound responsive decorative lighting arrangements commonly referred to as "light organs". In particular, the present invention comprises a sound responsive decorative light display including an array of light-emitting elements selectively actuated in a step-by-step manner in response to a sound input; the rate of stepping being controlled by the intensity of the sound field.

BACKGROUND OF THE INVENTION

The popularity enjoyed by hi-fidelity sound reproduction equipment over the last few decades has spawned development of various accessories to be used in conjunction with listening to music. One popular species of these accessories has been a sound-responsive light display commonly known as a "light organ".

In most conventional light organs an audio input signal is divided into two or more discrete frequency bands by electronic filters. The output of these filters is proportional to the energy within the filter's bandwidth in the sound field. The outputs of the filters are used to turn on light-emitting elements of different colors; there usually being a separate color for each band. A common arrangement has been to intensity modulate each light according to the output level from the filter driving the light.

While this type of device has enjoyed some popularity, the visible output from such devices tends to be very repetitious, particularly in response to certain types of music such as loud rock music. For example, the light-emitting element connected to the filter responsive to the lowest range of frequencies tends to pulsate to some degree while the other lights remain lit at a more or less constant intensity. One previous system proposed to overcome this phenomenon, which was characterized as a "threshold problem", using a modified differentiation circuit to render the individual lights responsive to changes, rather than absolute value, in intensity within each band covered by a filter. While it is believed that this has led to some improvement, there is still very little variety in the overall impression made by the visible output to be derived from such devices.

Other light-emitting decorative or entertainment devices have included articles of personal jewelry with an array of LEDs sequentially lit in a sequence determined by pseudo random number generators. One such system proposed switching from a first array of LEDs having a first set of colors to a second array of LEDs having another set of colors in response to the intensity of a local sound field detected by a microphone.

Heretofore no prior art light organ arrangement has provided a simple, inexpensive, sound actuated light display which is readily and selectively adjustable to provide visible display outputs of widely differing characteristics in the same device.

While the characterization of the output of a light organ as interesting or boring is highly subjective, it is believed by the inventor of the present invention that increasing the variety of possible patterns in the visible display, and the ability to selectively create styles of patterns by adjustments of front panel control knobs, each of which dynamically changes in response to the intensity of a sound field, provides a much more interesting visible output. This variety will hold the attention of the user for a greater length of time than conventional light organs.

SUMMARY OF THE INVENTION

It has been discovered by the inventor of the present invention that displays of great variety, and which the inventor believes to be more interesting to the user than prior art light organs, is provided by using an arrangement of light-emitting elements which are indexed by sequential circuitry wherein the rate of indexing is controlled by the intensity of the local sound field. Thus, the present invention basically comprises an electrical sound transducer and an array of light-emitting devices, preferably light-emitting diodes, connected to an indexing arrangement for sequentially activating each of the light-emitting devices wherein the speed at which the sequence is executed is proportional to the intensity of the sound field in which the microphone is placed. It is preferable to make the speed of stepping directly proportional to the intensity of the sound field although it is within the scope of the present invention to make same inversely proportional.

In its preferred form, the present invention provides an array of light-emitting devices mounted so as to have each member of the array at a point defined by a pair of coordinates along orthogonal axes. In its most preferred form, the orthogonal axes are the conventional radius and angular coordinates of the planar polar coordinate system.

Also, the preferred form of the intensity to frequency conversion apparatus of the present invention is a set of inexpensive voltage controlled oscillators provided in conventional integrated circuit timers or phase locked loops.

In its preferred form, the present invention provides a separate voltage controlled oscillator to control the rate of stepping along each of the orthogonal axes, each of which has a separate, independently adjustable, quiescent frequency. Thus, in response to a low level sound field, the present invention may be adjusted to step along one coordinate access at one rate and along another coordinate access at a different rate providing a great variety of different visible display outputs.

In its preferred form, the present invention uses an array of light-emitting diodes driven by decoded outputs of counters whereby one and only one light-emitting diode is activated at any one time. The persistence of human vision and the persistence of the light-emitting diodes will give the subjective impression of a large number of the diodes being illuminated at one time, except under the slowest conditions of stepping described hereinbelow.

It is further within the scope of the present invention to reverse the direction of stepping along one or more axes and to provide a third magnitude to frequency conversion apparatus to control the rate at which this reversal takes place.

It is therefore an object of the present invention to provide an inexpensive light organ which is readily adjustable by a plurality of independent adjustments to provide a large variety of different visible outputs in response to the same sound input.

It is a further object of the present invention to provide a light organ which will hold the user's attention for longer periods of time than prior art light organs.

It is a further object of the present invention to provide a light organ having an array of light-emitting elements arranged along a pair of orthogonal axes wherein input connections along each of the orthogonal axes are sequentially stepped so that one and only one of the light-emitting elements is actually activated at any particular time and which can use the persistence of human vision and the light-emitting devices to provide the illusion that a plurality of the devices are activated at once.

It is a further object of the present invention to provide a light organ display which is dynamic in character and provides to the user the illusion of movement about the array in response to intensity of the sound field.

It is still a further object of the present invention to provide a sound responsive array of light-emitting devices which are actuated according to a count sequence driven by a plurality of counters clocked by a plurality of voltage controlled oscillators, wherein each of the voltage controlled oscillators has an independently adjustable quiescent frequency.

That the present invention accomplishes these objects and overcomes the shortcomings of the prior art referred to hereinabove will be understood from the detailed description to follow.

DETAILED DESCRIPTION

Figure 1:
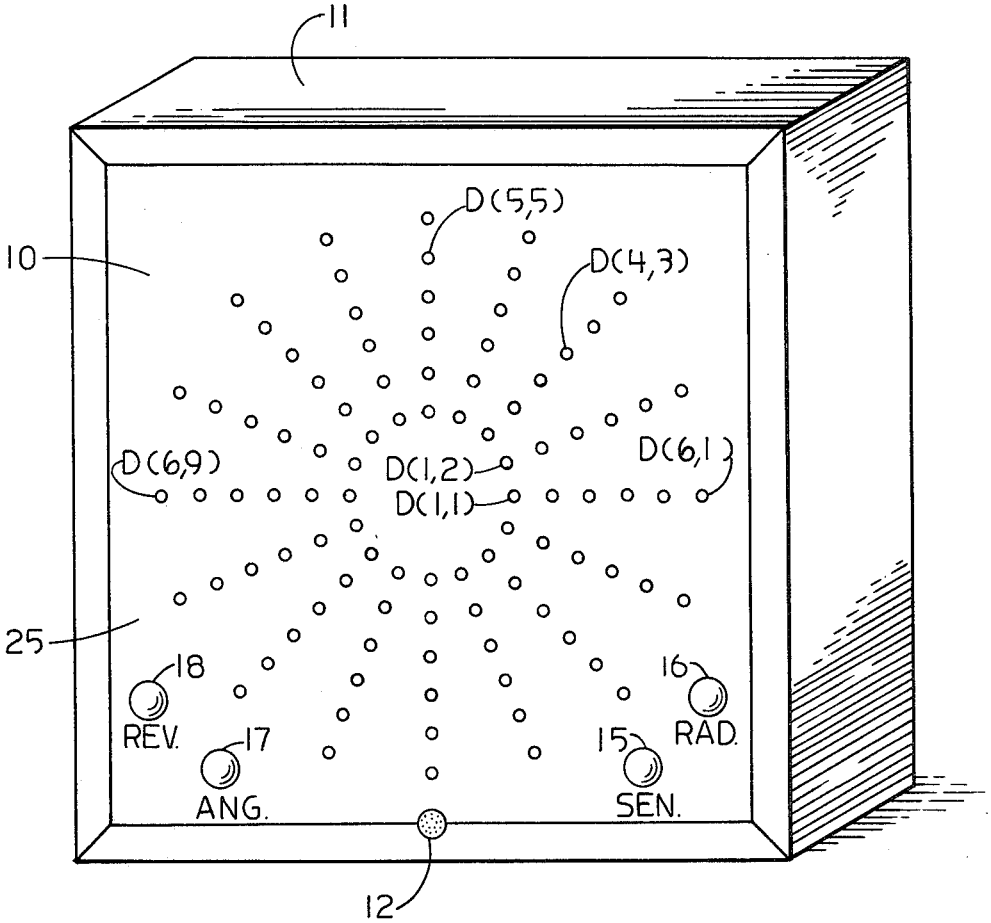
FIG. 1 is a pictorial view of the preferred embodiment of the present invention.

Turning now to the drawing figures in which like numerals represent like parts, the preferred embodiment of the present invention will be described.

FIG. 1 shows a pictorial view of the preferred embodiment of the present invention. The preferred embodiment includes a mounting board 10 upon which is arranged an array of ninety-six light-emitting diodes. The array in the preferred embodiment is arranged as a six-by-sixteen array in conventional polar coordinates. As noted hereinabove, the preferred form of the present invention is to use an array of light-emitting diodes arranged along two orthogonal axes. In the preferred embodiment, the orthogonal axes are the radius vector and the angular vector of conventional planar polar coordinates. As used throughout the specification, the preferred form of the present invention using two orthogonal coordinates will refer to each diode by an ordered coordinate pair in the form D(k,l) wherein k denotes the position along the first coordinate and l notes its position along the second coordinate axis. Thus, generally described, the preferred form of the present invention uses a M x N array of M times N diodes wherein each diode is designated as D(k,l) where k is equal to an integer between 1 and M and 1 is equal to an integer between 1 and N.

On FIG. 1 several of the light-emitting diodes are indicated according to this scheme of notation to illustrate the principle.

A microphone 12 is housed in the lower portion of mounting board 10 and is preferably an electret microphone. Mounting board 10 is disposed on the front of a housing 11 which contains the circuitry of the preferred embodiment.

Four control knobs 15, 16, 17 and 18 are mounted on the front of mounting board 10. In the preferred embodiment each of these is connected to a potentiometer, the function of which will be described in further detail in connection with FIG. 3. Each of control knobs 15–18 controls one of the following functions: sound sensitivity; radial stepping rate; angular stepping rate; and angular reversal rate.

Figure 2:
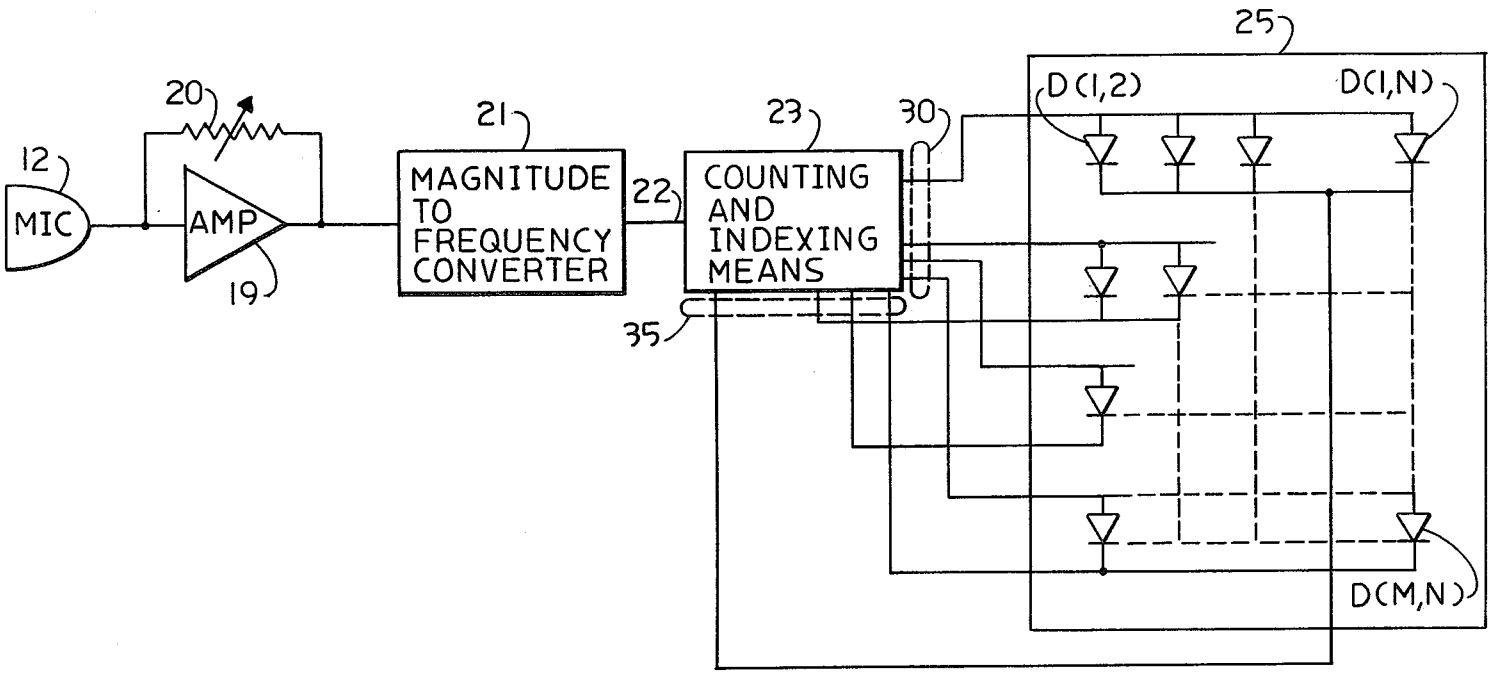
FIG. 2 is a block diagram of the present invention.

Turning next to FIG. 2, a block diagram of the circuitry of the present invention may be seen. Microphone 12 is placed in the local sound field and provides electrical signals to amplifier 19 and amplifies same to provide a sound output signal. The gain of amplifier 19 is adjusted by potentiometer shown as 20.

The output of amplifier 19 is provided as an input to magnitude to frequency converter 21, which as noted above, is preferably embodied by one or more voltage controlled oscillators.

The output of magnitude to frequency converter 21 is provided as a signal of varying frequency on line 22. Thus it should be understood that the frequency of the signal appearing on line 22 will be proportional to the intensity of the sound field in which microphone 12 is placed.

The variable frequency signal on line 22 is provided as the input to a counting and indexing arrangement shown as block 23. It should be understood that counting an indexing means 23 contains a plurality of counters having clock inputs driven by the variable frequency signal on line 22. Counting and indexing means 23 provides decoded outputs on buses 30 and 35 to LED array 25.

As noted above, the preferred arrangement of the present invention is to use array 25 arranged along orthogonal axes and connections where one and only one of the light-emitting diodes is activated at one time. It is within the scope of the present invention to provide an arrangement where sub-sets of first terminals (for example the anodes of the diodes) are connected together into a set of first connection points and other sub-sets of the second terminals of the diodes (for example the cathodes) are connected together whereby more than one of the LEDs would be activated in response to any particular counting state of counting and indexing means 23.

However, in the preferred form, bus 30 provides a plurality of lines one and only one of which will be in an active condition during any one counting state of counting and indexing means 23. Similarly, bus 35 provides decoded outputs. One and only one of the lines comprising bus 35 will be in an active condition at any one time. Thus one and only one of the diodes in array 25 will be activated at a time.

As used herein, the type of light-emitting devices used in the present invention will be referred to as having two terminals. It is further defined that a particular type activation signal appropriate for each terminal may be selectively provided to each of the devices.

In response to the concurrent presence of the appropriate type activation signal to each terminal of one of the devices, the device will become activated. A high voltage condition and a ground condition across the two terminals of a conventional light bulb is one example.

In the preferred form, a high voltage condition is a first type activation signal at a first input terminal which is the anode of the LEDs. Similarly, a low voltage or a current sinking ground condition is the second type activation signal at the second input terminal (the cathode) of LEDs.

Figure 3:
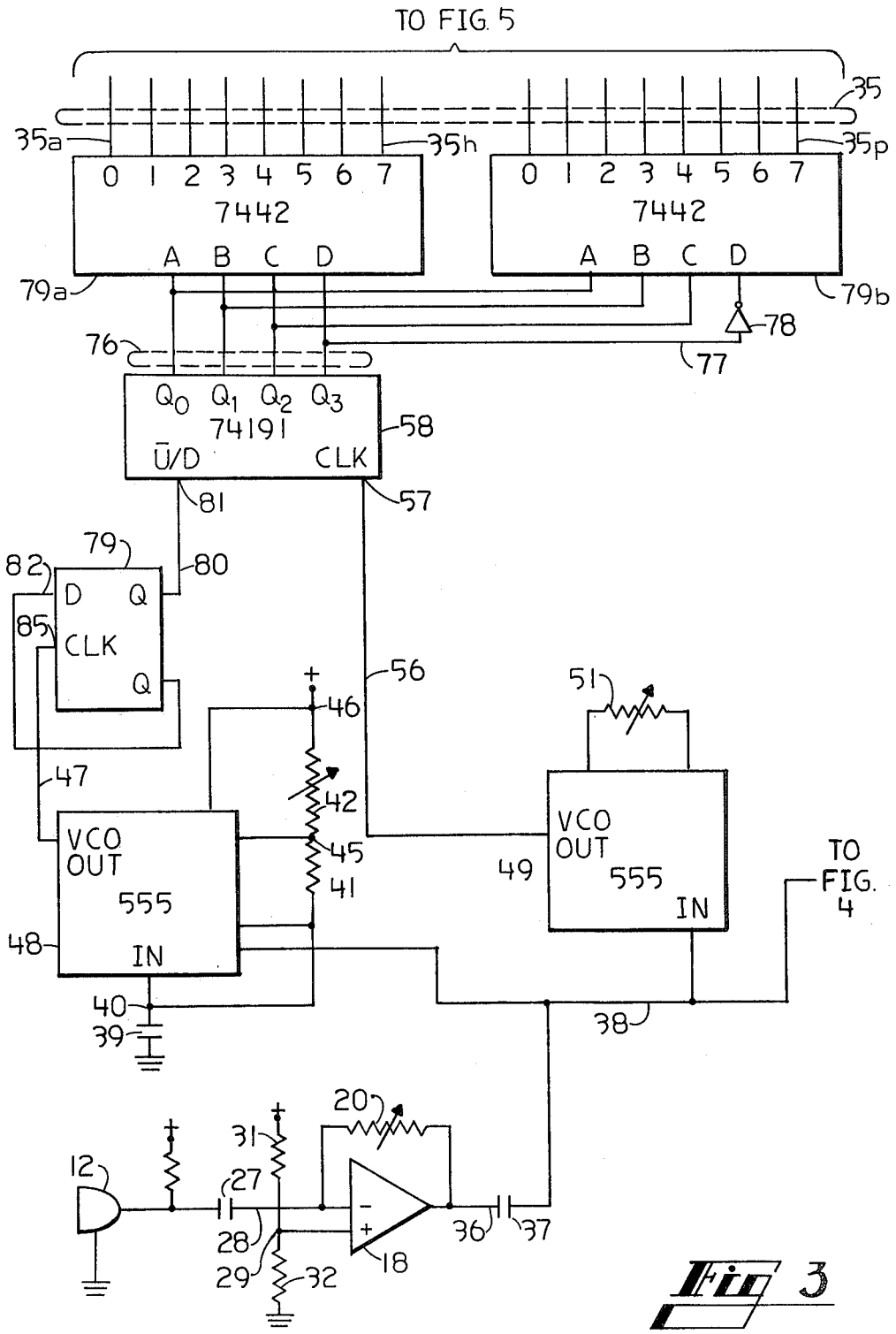
FIGS. 3 and 4 are schematic diagrams of the sound responsive and indexing circuitry of the preferred embodiment of the present invention.
Figure 4:
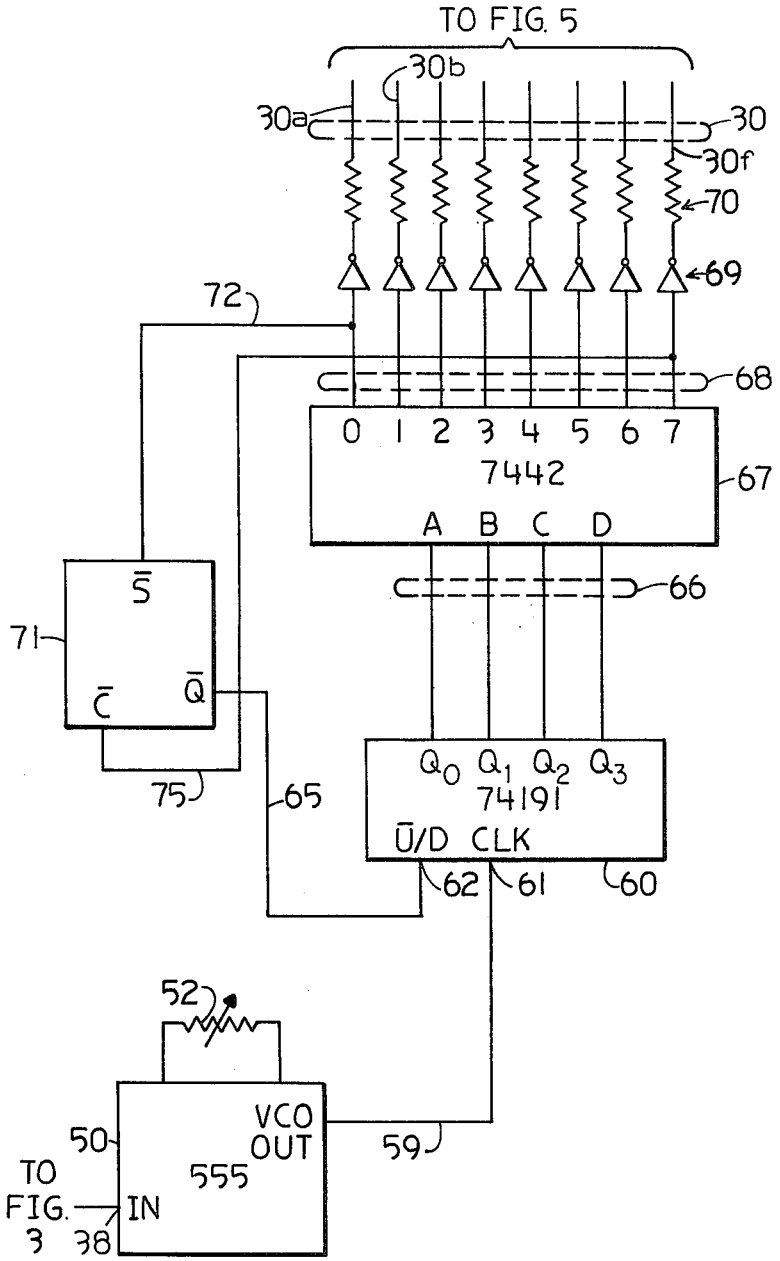

Turning next to FIGS. 3 and 4, the circuitry of the preferred embodiment of the present invention will now be described. It should be understood that line 38 shown on FIGS. 3 and 4 is electrically the same and connects the two figures.

Microphone 12, shown in FIG. 3, is responsive to the local sound field in which it is placed to provide electrical signals which are coupled through coupling capacitor 27 to line 28, the inverting input of operational amplifier 19. The non-inverting input 29 of op amp 19 is held at a constant voltage determined by the voltage divider consisting of resistors 31 and 32. Variable negative feedback is provided by potentiometer 20 which should be understood to be controlled by control knob 15 shown in FIG. 1 to vary the gain between line 28 and the output of the op amp circuit which appears on line 36. The output from op amp 19 on line 36 is coupled through DC blocking capacitor 37 to line 38.

In the preferred embodiment, op amp 19 is embodied by a type CA 3140 BiMOS operational amplifier currently manufactured by RCA. Of course, many alternate arrangements for a variable gain amplifier will suggest themselves to those skilled in the art.

The output signal on line 38 will be an amplified representation of the sound field present in microphone 12 and will be referred to as a sound output signal. Line 38 provides inputs to three voltage controlled oscillators built around 555-type integrated circuit timers 48, 49 and 50.

It will be understood by those skilled in the art that the 555 integrated circuit timer is a commonly available linear integrated circuit manufactured by several semiconductor manufacturers, including National Semiconductor, Motorola and Signetics. The arrangement of the timing circuitry is shown in connection with timer chip 48. It should be understood that identical arrangements are provided around timers 49 and 50 but only variable resistive elements 51 and 52, corresponding to variable resistor 42, have been shown for the sake of simplicity.

It is known to those skilled in the art that 555-type timers available from alternate sources are pin compatible and the pin-outs described herein in connection with this the best mode of the present invention will refer to those as published by National Semiconductor in their "Linear Data Book" publication describing this device. Section 9 of said Linear Data Book is hereby incorporated by reference exactly as if set forth in full herein.

Line 38 is provided to an input labeled IN on timer 58. It should be understood that this is the control voltage input at pin 5 of a 555 timer The controlling elements, capacitor 39 and resistors 41 and 42, are connected to timer 48 to provide a variable frequency astable multivibrator and is thus a species of voltage controlled oscillator. Point 40, which is connected to one side of capacitor 39 and the lower end of resistor 41, is electrically connected to pins 2 and 6 of the 555. Point 45 at the node connecting resistors 41 and 42 is connected to pin 7 which is the discharge pin of the timer. Point 46 is connected to the positive power supply, the top of variable resistor 42, and pin 8 of the timer.

The output on line 47, labeled VCO out on FIG. 3, is connected to the conventional output pin 3 of the 555. As is known to those skilled in the art, an increase in the voltage on line 38 (pin 5) for a 555 timer (having control elements as shown in connection with timer 48) will cause the frequency of the output signal on line 47 (pin 3) to increase.

Hence, as noted above, this arrangement provides a voltage controlled oscillator and is a species of magnitude to frequency converter since the frequency of the output on line 47 is proportional to the magnitude of the signal present on line 38. As used herein, the concept that an output frequency is proportional to the magnitude of an input signal includes both direct and inverse proportionality, but the best mode of the present invention is believed to be that shown in FIG. 3 in which the output frequency of timers 48, 49 and 50 is directly proportional to the sound output signal on line 38.

As noted above, timers 49 and 50 should be understood to have substantially identical control circuitry arrangements connected thereto but only variable resistances 51 and 52 have been shown. It will be understood by those skilled in the art that variable resistances 42, 51 and 52 vary the quiescent frequency at which the oscillators built around timers 48, 49 and 50 run in response to a zero input on line 38. The output of each of timers 48, 49 and 50 appears, respectively, on lines 47, 56 and 59. It should be appreciated that variable resistances 42, 51 and 52 are each independently adjustable and thus provide a means for independently adjusting the quiescent frequencies of the clock signals appearing on lines 47, 56 and 59 in response to a predetermined magnitude of the sound output signal present on line 38.

In the preferred embodiment, capacitor 39 is chosen to be one hundred microfarads, resistor 41 to be one kilohm, and resistor 42 to be variable between a value of a few hundred ohms to several megohms. Since the control elements associated with timers 48–50 are arranged to make the entire circuit a voltage controlled oscillator, these elements will be referred to as voltage controlled oscillators or "VCOs" in this specification.

As shown on FIG. 4, the output of VCO 50 appears on line 59 to the clock input 61 of counter 60. Counter 60 is a conventional four bit binary up/down counter, which, in the preferred embodiment, is embodied as a type 74LS191 low power Schottky TTL counter currently manufactured by Motorola Semiconductor Products and others. Operation of this type counter is well known to those skilled in the art but is more particularly described beginning at page 4-158 of a data book entitled "Motorola Low Power Schottky TTL" currently published by Motorola Semiconductor Products, Inc., which is hereby incorporated by reference.

Counter 60 provides a binary count output between zero and fifteen (0000 and 1111) on outputs 66 in response to positive clock transitions at input 61. Counter 60 counts up when a logical zero is present at input 62 and down when a logical one is present. Thus, input 62 is referred to as a "NOT UP/DOWN" input and is generically an up/down input which is responsive to a logical zero thereon as an up input condition to cause the counter to count in one direction, and to a logical one as a down count condition to count in the opposite direction.

The outputs 66 of counter 60 are provided as inputs to a decoder 67. Decoder 67, in the preferred embodiment, is a type 74LS42 low power Schottky BCD to one of ten decoder currently manufactured by Motorola Semiconductor Products, Inc. and others. Counter 67 treats the four bit number on line 66 as a binary coded decimal (BCD) and decodes this number to take one and only one of its output lines 68 to a logical zero condition. The 7442 counter is constructed so that any four bit binary number greater than nine (1001) will maintain all of output line 68 in a logical one condition. Thus, the 7442 serves as a three line to one of eight decoder with the most significant input bit (at input D) as an enable pin. Only the six least significant outputs of decoder 67 are used in the preferred embodiment as shown in FIG. 3.

The states of outputs 68 are inverted by an array of inverters 69, the outputs of which are coupled to current limiting resistors 70. These lines continue to form a first axis bus 30 shown in FIG. 3. The connection of bus 30 to the light-emitting diodes of the preferred embodiment will be discussed in greater detail in connection with FIGS. 5 and 6. It should be understood that first axis bus 30 has outputs conditioned by inverters 69 and current limiting resistors 70 to be appropriately tied to the anode of a light emitting diode to provide current thereto.

A direction control means is provided to control the direction of count for counter 60 by flip-flop 71. The decoded zero output of decoder 67 is connected by line 72 to the direct negated set input of flip-flop 71. Similarly, the negated five output of decoder 67 is connected to the negated clear input of flip-flop 71 by line 75. The negated output of flip-flop 71 is connected by line 65 to the up/down control input 62 of counter 60.

Thus, whenever counter 60 reaches a zero count, line 72 goes low setting flip-flop 71 which provides a logical zero on line 65. This condition causes counter 60 to begin counting in the up direction in response to the next series of clock pulses appearing at input 61. When counter 60 counts to its five count state (0101), line 75 is driven low clearing flip/flop 71 placing a logical one on line 65 causing counter 60 to again begin counting down.

Therefore, that counter 60 continuously counts up and down between the numbers zero and six in response to clock signals on line 59. During this counting, a pattern will appear on first axis bus 30 in which the one of these lines which is in a logical one state will move back and forth from left to right continuously as the lines are represented in FIG. 3.

It will thus be appreciated that flip-flop 71 comprises part of a direction control means which changes the state of up/down count input 62 in response to counter 67 reaching first and second predetermined counts; that is, zero and five.

While it will be discussed in further detail in connection with FIGS. 5 and 6, it should be appreciated that if any particular value of the angle coordinate is chosen for the array of LEDs shown in FIG. 1, the counting of counter 60 will have the following effect. Assume that counter 60 is counting in the sequence described and that the $\phi=1$ angle value has been determined by the other circuitry. This corresponds to the row of six LEDs on the righthand side of the array shown in FIG. 1 beginning with diode D(1,1) and ending with diode D(6,1). Under these conditions, as counter 60 counts, the particular one of these six diodes which is illuminated will progress from right to left and left to right alternatively. Adjustment of variable resistor 52 will cause the rate at which the stepping occurs to change, assuming a given sound output signal on line 38.

Turning now to the circuitry which indexes the value of the angle coordinate on FIG. 3, it will be appreciated that it is quite similar in construction to the circuitry for indexing the radius coordinate described immediately hereinabove. VCO 49 provides clock signals of variable frequency on line 56 in response to the sound output signal on line 38. These signals drive clock input 57 of counter 58 which, in the preferred embodiment, is identical to counter 67. The outputs 76 of counter 58 are connected to the inputs of decoders **79*a* and 79*b* which, in the preferred embodiment, are each identical to decoder 67**.

The most significant output bit of counter 58 is connected by line 77 to inverter 78, the output of which is applied to the most significant input of decoder **79*b*. It will be readily apparent that each of decoders 79*a* and 79*b* is being used in the above described manner as a three line to one of eight decoder treating the most significant input (the D input) as an enable input. During the first eight counts of counter 58, decoder 79*a* will be enabled. When counter 58 is in a count state greater that eight (greater than 1000), counter 79*b* will be enabled. Thus, counters 79*a* and 79*b*, taken together are acting as a four line to one of sixteen decoder to provide a logical zero output on one and only one of the lines of second axis bus 35 in response to any particular count of counter 58**.

Since the active output of decoder 79 is in a low state, it is appropriate to connect the cathodes of the light-emitting diodes in the array of the preferred embodiment to the lines of bus 35. Thus, when a light emitting diode with its anode connected to the active line of bus 30 (logical one) and its cathode to the active line of bus 35 (logical zero), the diode will have a first terminal activation signal at its first terminal (logical one at anode) and a second terminal activation signal at its second terminal (current sinking logical zero at cathode), and will thus be activated into a light-emitting condition in response to the concurrent presence of these signals.

If the above-described circuitry associated with counter 58 and decoder 79 is again considered in connection with FIG. 1, it will be apparent that the following output is derived. Assuming that the radius line of bus 30 which is active remains the same; (for example, the most significant line corresponding to the outer circle of LED shown in FIG. 1) as counter 58 counts in one direction, the illuminated LED will be seen to march around the outer perimeter of the array in a clockwise direction. When the direction of count for counter 58 is reversed, this apparent movement of the lighted LED will proceed in a counterclockwise direction.

It has been discovered by the inventor of the present invention that the ability to independently vary the rate at which the reversal of this apparent clockwise and counterclockwise movement occurs provides a very pleasing effect in a light organ. To that end, a second direction control means is provided for counter 58 which includes VCO 48 and flip-flop 79. The NOT UP/DOWN input 81 of counter 58 is connected to line 80 which carries the asserted form of the output of D-type flip-flop 79. The negated output of flip-flop 79 is coupled by line 82 to the D input. Thus it will be appreciated that each time the clock transition to which flip-flop 79 is sensitive occurs on line 85, the output state on line 80 of flip-flop 79 will change, thus changing the direction input at 81 to counter 58.

Clock input 58 of flip-flop 79 is driven by clock signals on line 47 from voltage controlled oscillator 48. Since variable resistor 42 allows the quiescent frequency of this oscillator to be independently adjusted, the quiescent frequency at which the direction of count for counter 58 changes may be adjusted independently of the other adjustable elements in the preferred embodiment. As the magnitude of the sound output signal on line 38 increases, the clock frequency on line 47 increases, thus increasing the rate at which the logical state on line 80 changes. This manifests itself as an increase in the rapidity with which the LED pattern appears to change its direction from clockwise to counterclockwise in the preferred array shown in FIG. 1.

From the foregoing it will be understood that VCO 48 and flip-flop 79 provide a second direction control means for alternately providing an up count signal and a down count signal to up/down input 81 of counter 58. This direction control means includes a third magnitude to frequency conversion means embodied by VCO 48; and its connection to flip-flop 79 provides a means for switching between the up count signal (logical zero on line 80) and the down count signal (logical one on line 80) at a rate that is proportional to the magnitude of the output signal on line 38. Furthermore, variable resistance 42 provides a means for selectively adjusting the quiescent rate of switching between the up count signal and the down count signal in response to any given predetermined value of the sound output signal on line 38.

At this point, it should be appreciated that the present invention provides the following features as a result of the above-described independent adjustment and connections to a diode array. Since first axis bus 30 is connected to select the particular radius value for the array shown in FIG. 1, and second axis bus 35 is connected to select the particular angle value (which of the "spokes") which contains an illuminated LED; and the quiescent clock frequencies driving the counters which select these lines may be independently adjusted by resistances 51 and 52; a virtually infinite variety of outputs in response to a given sound signal at microphone 12 are possible.

Consider that if resistor 52 is adjusted to provide a relatively low frequency signal on line 59, and resistor 51 is adjusted to provide a relatively high frequency on line 56, the apparent motion of a lighted LED which will appear in the array of FIG. 1 will be one in which the radius value changes slowly but the particular angle of the LED illuminated changes very rapidly. Indeed, it is quite easy to adjust resistances 51 and 52 so that one gets the illusion of a circle of all LEDs of a particular radius being illuminated; the circle expanding and contracting in a predetermined rhythm when the value of the sound output signal is constant. When a sound output signal present on line 38 is varying, the rate of expansion and contraction of this circle varies in proportion of the intensity of the music, or other sound input being used.

If one uses a similar adjustment, but adjust resistance 42 so that a relatively high clock frequency appears on line 80, the apparently illuminated portion of the array will be confined to a generally pie-shaped section of the array shown in FIG. 1 since the reversing of the direction of counter 58 may be adjusted so that it occurs at a rate faster than the counter can count through its entire sequence.

Experience with a physical embodiment of the preferred embodiment has shown that these and many many other various effects are possible from the independent adjustment of resistances 42, 51 and 52 in conjunction with different types of sound inputs in microphone 12.

It will be appreciated from inspection of FIGS. 3 and 4 that the preferred embodiment is constructed from a relatively small number of readily available inexpensive parts and that a very wide variety of visible displays in response to sound input of microphone 12 may be derived from the adjustment of resistances 42, 51 and 52.

Figure 5:
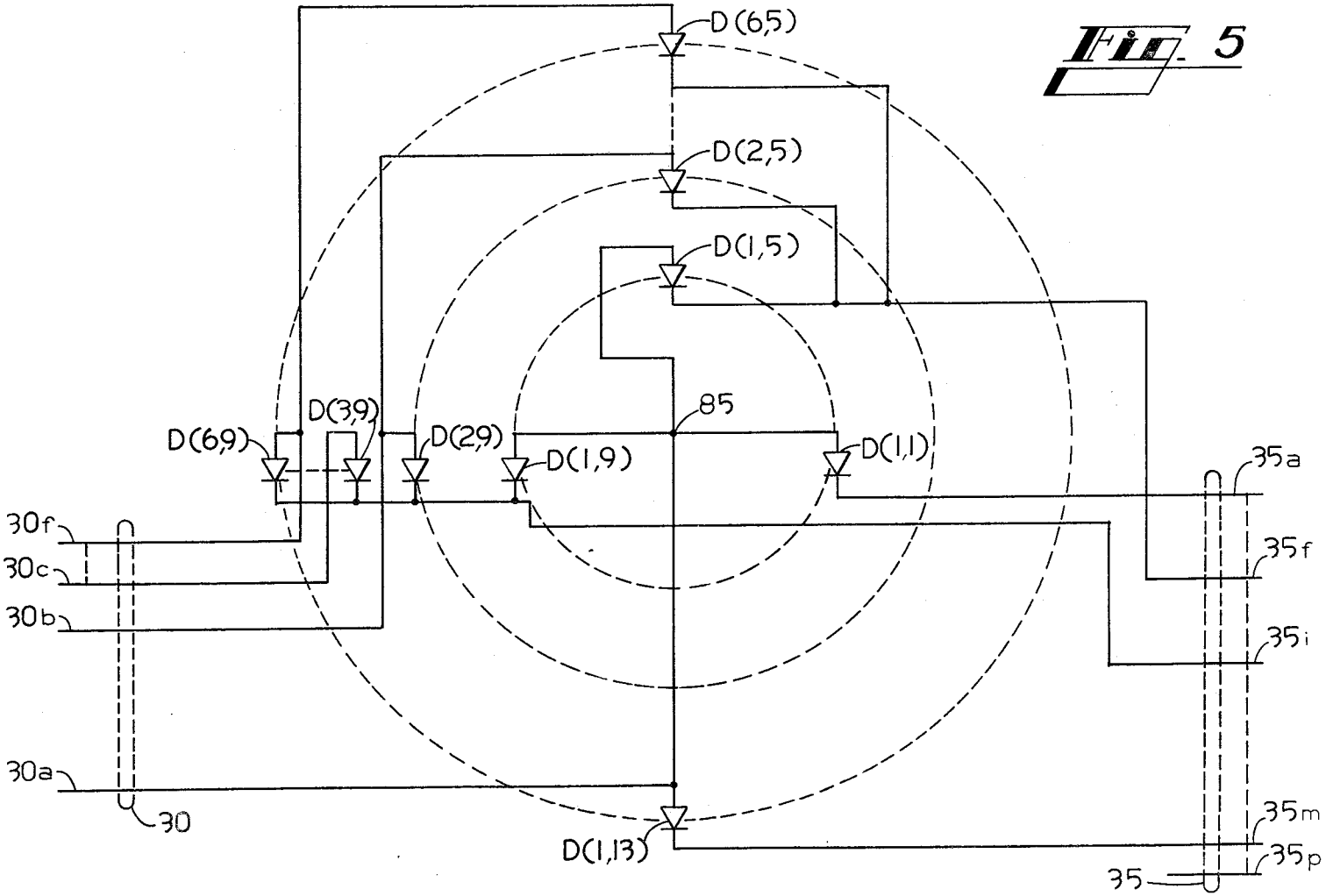
FIG. 5 is a diagram of the interconnection of the members of the light-emitting diode array in the preferred embodiment.

Turning next to FIG. 5, the connection of the diodes of the array in the preferred embodiment will be described in detail.

FIG. 5 shows the interconnection of an exemplary sample of the ninety-six diodes arranged in a circular array as shown in FIG. 1. The diode positions on FIG. 5 are denoted by the ordered pair described hereinabove in the format D(r,∅) wherein the R is in the position on the radius vector of the diode and ∅ is the angular position of the diode in the array.

First axis bus 30 (the radius bus) consists of six lines denoted as 30*a*–30*f*. Also, second axis bus 30 (the ∅ or angular bus) consists of sixteen lines denoted 35*a*–35*p*. These correspond to the lines shown on FIG. 3. It should be appreciated that the anodes of all diodes at radius position one, four of which are shown in FIG. 4, have a common connection to line 30*a*. This may be seen by inspection of FIG. 5 wherein it may be seen that the anode of each of diodes D(1,1); D(1,5); D(1,9); and D(1,13) are all connected to the electrically identical point 85. In a similar manner, the anodes of all diodes at the radius position two are connected to line 30*b* of bus 30, and so forth until all anodes of the diodes at radius position six are connected to line 30*f*.

The cathodes of the light-emitting diodes are connected to respective lines of bus 35. As shown in FIG. 5, the diodes of angular position one have their cathodes connected to line 35*a*. This corresponds to the six diodes extending horizontally to the righthand side of the array shown in FIG. 1. Similarly, the diodes at angular position two (not shown on FIG. 5) will be connected to line 35*b*; the cathodes of those at angular position five (straight up in the drawings) are connected to line 35*f*, and so on.

Thus, for any given state of counters 58 and 60 (FIGS. 3 and 4), one and only one diode of the array shown in FIG. 5 will have its anode connected to the positive line from bus 30 and its cathode connected to a current sinking logical zero line from bus 35, and will thus conduct and emit light. As noted above, the rapid indexing of the particular diode in the array which enjoys this coincidence at any given time, together with the persistence of the light-emitting characteristics of the diodes and human vision, provide the illusion that multiple diodes are operating at one time. The diodes shown in FIG. 5 comprise light-emitting diodes and they are characterized by a first terminal, the anode, and a second terminal, the cathode. It will be appreciated that these are light-emitting devices which are activated in response to the concurrent presence of a first terminal activation signal at the first terminal (positive voltage at the anode) and the second terminal activation signal at the second terminal as described hereinabove. It will further be appreciated that the interconnected wiring shown in FIG. 5 comprises a connection means for connecting a plurality of sub-sets of the first terminals (anodes) to provide a plurality of first axis connection points. In the preferred embodiment, the first axis is the radius axis and lines 30*a*–30*f* of bus 30 are electrical connection "points". The plurality of sub-sets of the first terminals are the sub-sets of anodes of diodes in the array at a common radial position. Similarly, the connections to bus 35 provide a connection means for connecting a plurality of sub-sets of second terminals (the cathodes) to provide a plurality of second axis connection points: lines 35*a*–35*p* of bus 35.

It will further be appreciated that counters 58 and 60, and decoders 67 and 79 comprise an indexing means for stepping to each of the above-described axis connection points, one at a time, to sequentially provide the necessary terminal activation signal (either high or low voltage condition depending on the terminal) to each of the light-emitting diodes. Also, the concurrent presence of a positive voltage at the anode and a ground condition at the cathode is on activation signal to one of the diodes in the array.

Furthermore, the array shown in FIGS. 1 and 4 comprises an M×N matrix, M and N being integers greater than one, of light-emitting devices mounted in an arrangement where each LED occupies a unique position on each of a pair of orthogonal axes. In the preferred embodiment, M is equal to six, N is equal to sixteen, the orthogonal axes are the r and ∅ axes of planar polar coordinates and each diode position is characterized by an ordered pair D(k,l). In the preferred embodiment, k is equal to an integer between one and six and 1 is equal to an integer between one and sixteen. It is considered by the inventor that the present invention includes embodiments of a 1×N array wherein N is an integer greater than one.

Similarly, adopting the same convention, it may be seen from FIG. 4 that there are M common connection points of the anodes (M=6) and N common connection points for the cathodes of the array (N=16).

Figure 6:
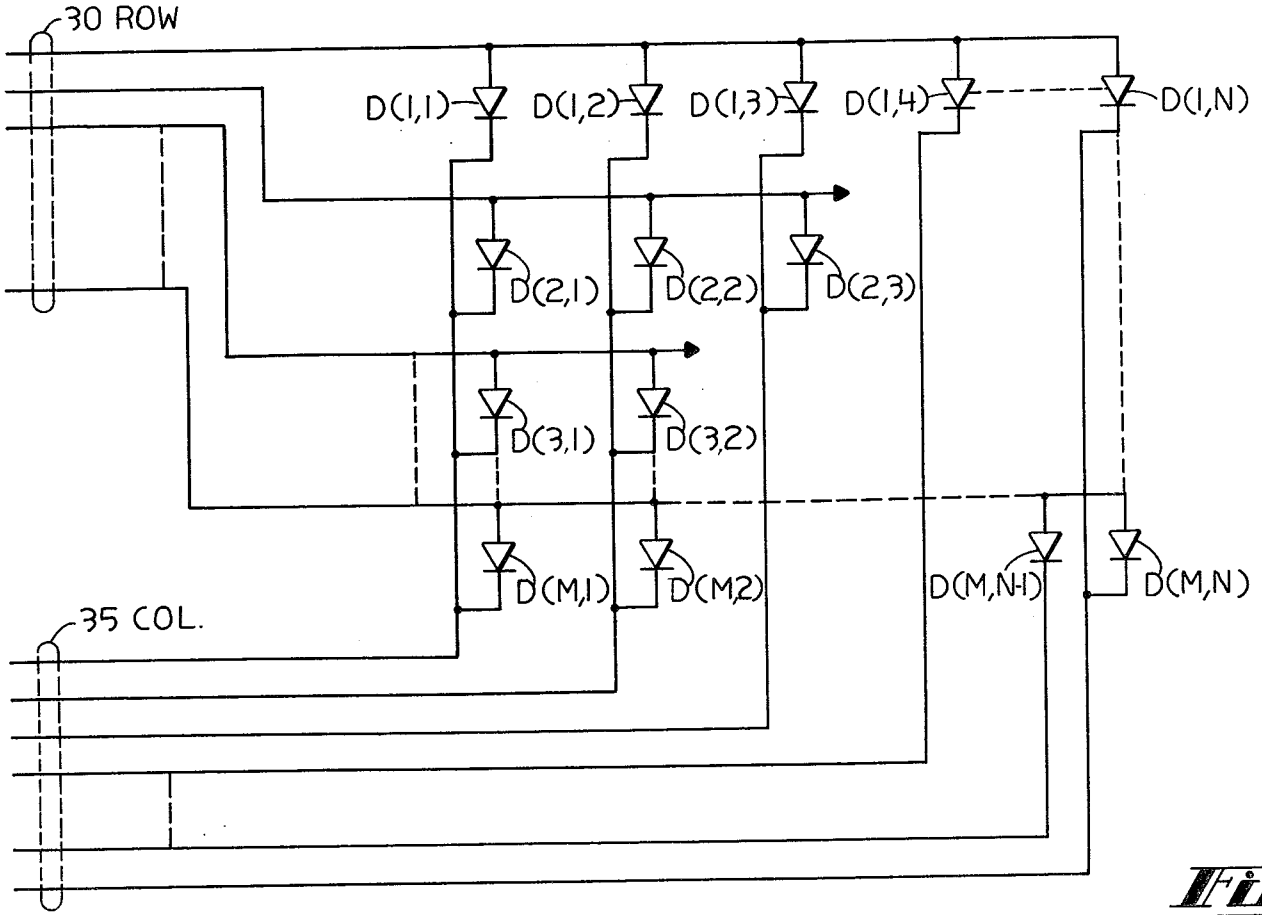
FIG. 6 is a diagram of the interconnections for an alternate arrangement of a two-dimensional array in the preferred embodiment wherein a rectangular array is used.

FIG. 6 shows an alternate arrangement of an array which is usable in an embodiment of the present invention. In FIG. 6 the diodes are shown in a generalized M×N rectangular array wherein the first axis may be considered a row or x axis and the second axis may be considered a column or y axis. It will be appreciated that if the rectangular array of FIG. 6 is specified to be a 6×16 rectangular array, the electrical interconnections of the diodes will be identical to that shown in the preferred embodiment and only the physical arrangement of the diodes on mounting board 10 (FIG. 1) would be changed.

It is of course possible to use other geometries for the arrays of light-emitting devices to construct embodiments of the present invention. It will further be apparent to those skilled in the art that it is not essential to the present invention that one and only one light-emitting devices be activated by any particular combination of signals but that it is preferred that there be a one-to-one correspondence between the possible pairs of states of counters 58 and 60 and a particular light-emitting device which is in an active condition. From the foregoing disclosure, it will readily be appreciated that three dimensional arrays of light emitting elements may be constructed according to the present invention with the third dimensions co-ordinate being indexed by an indexing arrangement of the type shown in FIGS. 3 and 4.

The foregoing has been a complete description of the preferred embodiment of the present invention and constitutes the best mode known to the inventors as of the writing of this specification. From the foregoing description it will be apparent that the preferred embodiment of the present invention accomplishes the objects of the invention set forth hereinabove and does provide an inexpensive and very versatile visual entertainment device responsive to sound. From the foregoing, other embodiments of the present invention may suggest themselves to those skilled in the art and therefore the scope of the present invention should be limited only by the claims below.

I claim:

1. A light organ comprising:

an M×N array, M and N being integers greater than one, of light-emitting devices mounted in an arrangement wherein each light-emitting device occupies a unique position on each of a pair of orthogonal axes characterized by a coordinate pair (k,l), wherein k is equal to integer between 1 and M and 1 is equal to an integer between 1 and N;

each of said light-emitting devices being characterized by a first terminal and a second terminal and further characterized by said light-emitting device being activated to a light-emitting condition in response to a concurrent presence of a first terminal activation signal at said first terminal and a second terminal activation signal at said second terminal;

a sound trandsucer for providing a sound output signal having a value proportional to the intensity of a sound field in which said transducer is located;

connection means for providing M first common connection points of said first terminals, each of said first common connection points connecting all of said first terminals for said light-emitting devices at point (k,l) for which k is identical and for providing N second common connection points of said second terminals, each of said second common connection points connecting all of said second terminals for said light-emitting devices at said point (k,l) for which 1 is identical;

a first indexing means including a first counter means for sequentially providing said first activation signal to each of said M first common connection points, one at a time, in response to a first clock signal;

a second indexing means including a second counter means for sequentially providing said second activation signal to each of said N second common connection points, one at a time, in response to a second clock signal;

a first magnitude to frequency conversion means connected to said sound transducer and said first counter means for providing said first clock signal characterized by a frequency proportional to the magnitude of said sound output signal;

a second magnitude to frequency conversion means connected to said sound transducer and said second counter means for providing said second clock signal characterized by a frequency proportional to the magnitude of said sound output signal;

means for independently adjusting the quiescent frequencies of said first and second clock signals in response to a predetermined magnitude of said sound output signal.

2. A light organ as recited in claim 1 wherein:

said first counter means comprises an up/down counter including an up/down input for controlling the direction of counting; and direction control means for changing said up/down input from an up input condition to a down input condition in response to said first counter reaching a first predetermined count, and for changing said up/down input from said down input condition to said up input condition in response to said first counter reaching a second predetermined count.

3. A light organ as recited in claim 1 wherein said second counting means comprises an up/down counter including an up/down input for controlling the direction of counting;

direction control means for alternately providing an up count signal and a down count signal to said up/down input;

said direction control means comprising a third magnitude to frequency conversion means for switching between said up count signal and said down count signal at a rate proportional to said magnitude of said sound output signal.

4. A light organ as recited in claim 3 wherein said third magnitude to frequency conversion means further comprising means for selectively adjusting a quiescent rate of said switching between said up count signal and said down count signal in response to a predetermined value of said sound output signal.

* * * * *